US005791570A

United States Patent [19]

Quadrana

[11] Patent Number: 5,791,570

[45] Date of Patent: Aug. 11, 1998

[54] MINCING UNIT FOR INDUSTRIAL MINCING MACHINES

[75] Inventor: Marcello Quadrana, San Lazzaro Di Savena (BO), Italy

[73] Assignee: Evolution S.R.L., San Lazzaro Di Savena (BO), Italy

[21] Appl. No.: 740,107

[22] Filed: Oct. 28, 1996

[51] Int. Cl.[6] ..... B02C 18/30; B02C 18/36

[52] U.S. Cl. ..... 241/82.5; 241/282.2; 241/292.1; 241/300

[58] Field of Search ..... 241/82.5, 86, 88, 241/292.1, 285.1, 285.2, 300

[56] References Cited

U.S. PATENT DOCUMENTS

| | | | |
|---|---|---|---|
| 1,015,403 | 1/1912 | Schaarschidt | 241/292.1 |
| 3,847,360 | 11/1974 | Seydelmann | 241/82.5 |
| 4,660,778 | 4/1987 | Fischer et al. | 241/292.1 |
| 4,844,372 | 7/1989 | Weiler et al. | 241/82.5 X |
| 5,092,528 | 3/1992 | Rudibaugh | 241/82.5 X |

FOREIGN PATENT DOCUMENTS

| | | | |
|---|---|---|---|
| 515085 | 12/1930 | Germany | 241/300 |
| 3935320 | 6/1990 | Germany | 241/292.1 |
| 291020 | 6/1991 | Germany | 241/82.5 |
| 296229 | 11/1991 | Germany | 241/82.5 |
| 308169 | 5/1933 | Italy | 241/82.5 |
| 1570768 | 6/1990 | U.S.S.R. | 241/82.5 |

*Primary Examiner*—John M. Husar
*Attorney, Agent, or Firm*—Harrison & Egbert

[57] ABSTRACT

A mincing unit for an industrial mincing machine having a stator, a rotor and a worm screw drivingly connected to the rotor and positioned within the stator. A set of disc-shaped dies are formed of progressively closer perforations. A set of star-shaped cutters alternate with the dies such that the cutters act on the dies at either end. The cutters are fitted with rectangular blades having a cutting edge surfaced with a wear-resistant material fixed externally to the blades. An element of wear resistant material is mounted on each spoke of the cutters. A freely rotating plate is mounted in an axial area of the cutters.

6 Claims, 6 Drawing Sheets

MINCING UNIT FOR INDUSTRIAL MINCING MACHINES

TECHNICAL FIELD

This invention relates to the cutters and dies used in industrial meat mincing machines which are normally alternated to form mincing unit "pack" into which mince is fed and forced through by a powerful worm screw, so that with each passage through the die's calibrated perforations, the movement of the cutter minces the meat progressively more finely, until the desired texture is achieved.

BACKGROUND ART

Currently, the cutters are star-shaped and made out of steel, and the blade holder is provided with a fixing device for the removable blades, also in steel, rectangular in shape and sharpened along the longer edges, so that they come into contact with the dies positioned at either end, thus performing their dual cutting action on mince.

The main drawback of this system lies in the fact that, due to the high pressure applied on the mince as it is forced through the perforations of the dies, the cutters and dies freely rotating around a central shaft come into very close contact, so that the friction generated between them is such that it causes heavy wear on the blades and then on the dies. This heavy wear is also partly caused by the breakdown of the lubricating film (animal fat) which is not very resistant to high pressure. This is why more power is required and, consequently, more energy is consumed. Blades need to be replaced frequently. Most importantly, because of the dispersion of metal particles removed by abrasion, the mince is found to be contaminated, and its quality impaired.

At present, the wear of blades and dies is due to the use of improper material. Such improper materials become so overheated during the mincing process that they approach their melting point, consequently shedding particles and oxidized metallic residue.

SUMMARY OF THE INVENTION

The solutions proposed here will reduce cutter wear, allowing them to last forty times longer than they do at present. Areas subject to seizures are eliminated. Temperatures are kept below 150° C. Given that the materials used retain their mechanical efficiency up to 800° C., and start to oxidize around 1000° C., one can expect drastic savings on working costs and, above all, an improvement in product quality, both in terms of metal particle contamination and the flavor of the mince which, with this method, will not be affected by localized burning.

This invention eliminates the drawbacks by proposing a new cutter design that, due to its special shape, allows the facing of the blade edge with highly wear resistant materials. Blades are currently built entirely in tool steel with different blade designs according to differential wear criteria, with different blade designs according to mince conveying optimization criteria. The blade is combined with the blade holder in a star-shaped tool that can be replaced where necessary. An auxiliary system is introduced to relieve pressure from the blades, radically altering traditional notions on cutters, and changing their conveying function in relation to mince itself. This invention furthermore presents a new die designed to reduce the mince processing path, thus reducing load losses.

These and other features will now appear to be more closely related to a simple way of applying the invention, illustrated merely by way of example, and not restrictive of the potential applications of this invention.

DETAILED DESCRIPTION OF THE PRESENT INVENTION

With reference to the above FIGS., 1 indicates the stator of the machine; 2 the drive shaft joined to the worm screw (3); 4 the fixed blade cutter (the fixed blades are indicated with 4'); 5 the facing in wear resistant material (STELLITE (™), tungsten carbide, chrome cobalt steel); 6 the first perforated plate or wide mesh die, joined in 6' to the stator (1); 7 the second tighter mesh perforated plate in tool steel joined to the stator in 7'; 8 the star-shaped cutter splined to the drive shaft (2) leader tongue 2'; 8' the removable tool steel blade, with a STELLITE (™) facing (5) fixed to the cutter (blade-holder) at 9. 7" indicates the gap that necessarily forms between the blade and the die, through which partially processed mince is conveyed which, recycled through the so-called "gristle discharge" tube, may cause alterations in the texture of the mince itself.

Figure 1:
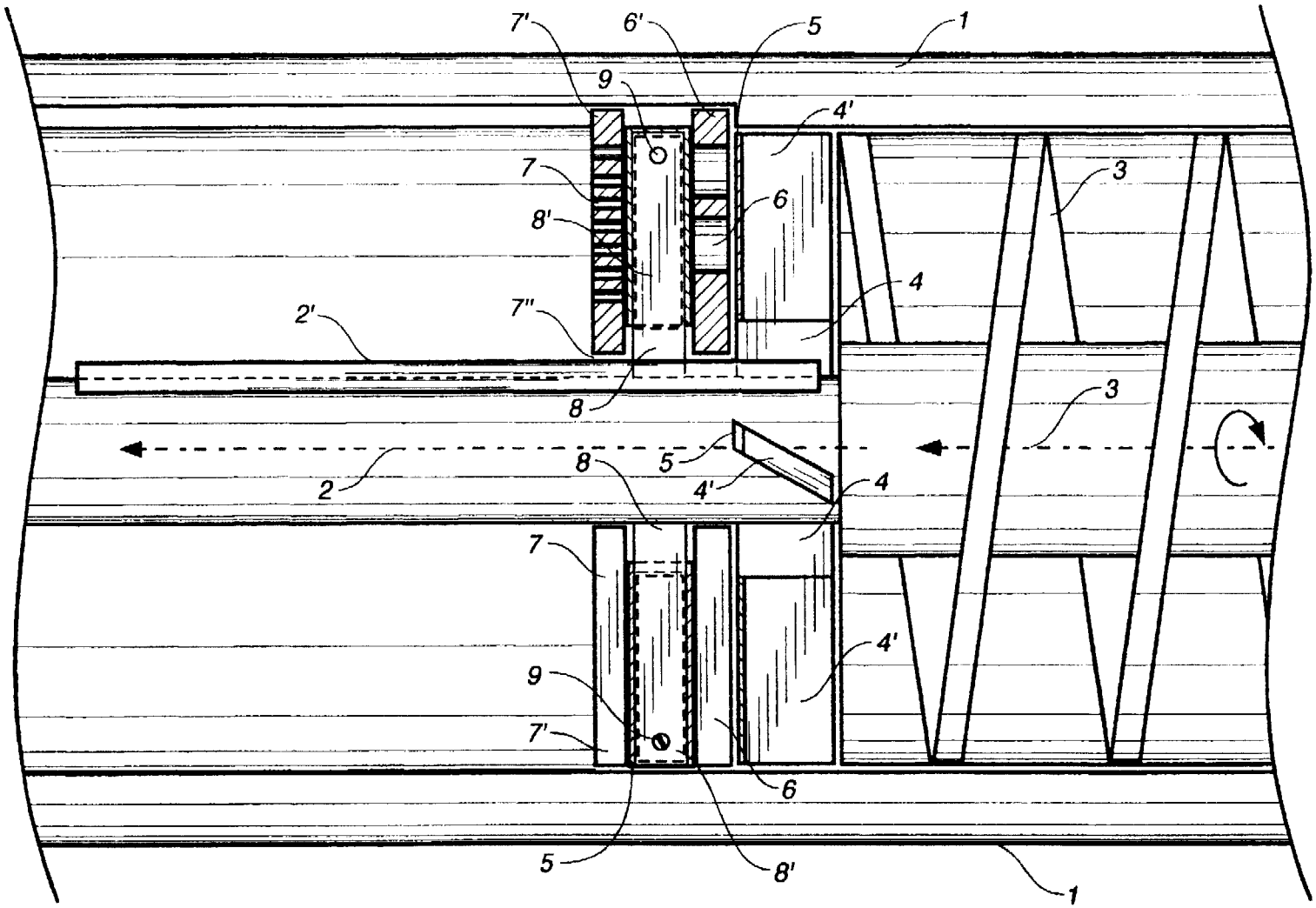
FIG. 1 is a diagram showing the operation of a partially modified mincing machine.
Figure 2:
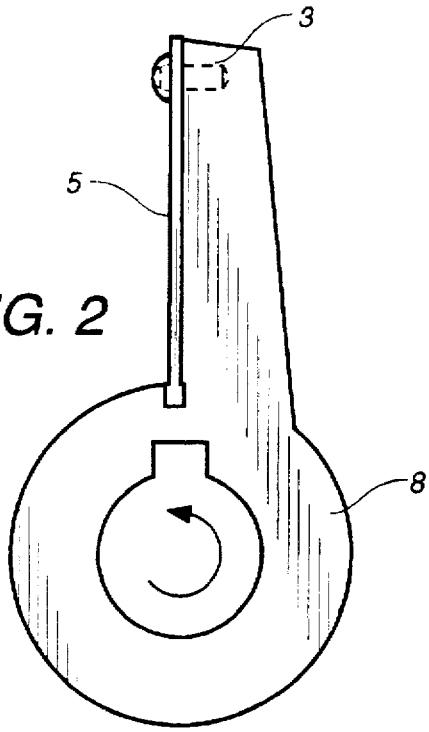
FIGS. 2–3 are a side and front view of a traditional blade where only the cutting edge has been modified, as shown in FIG. 1.
Figure 3:
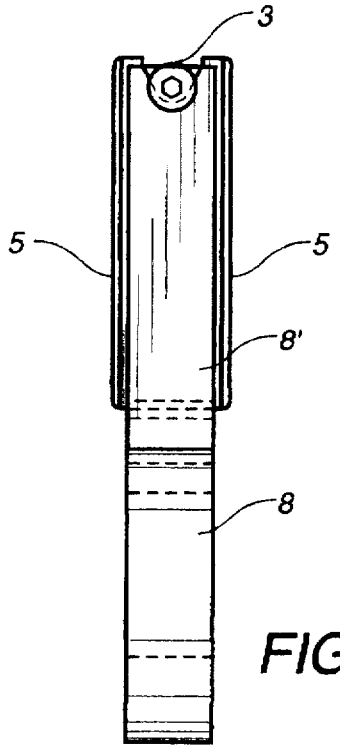
Figure 4:
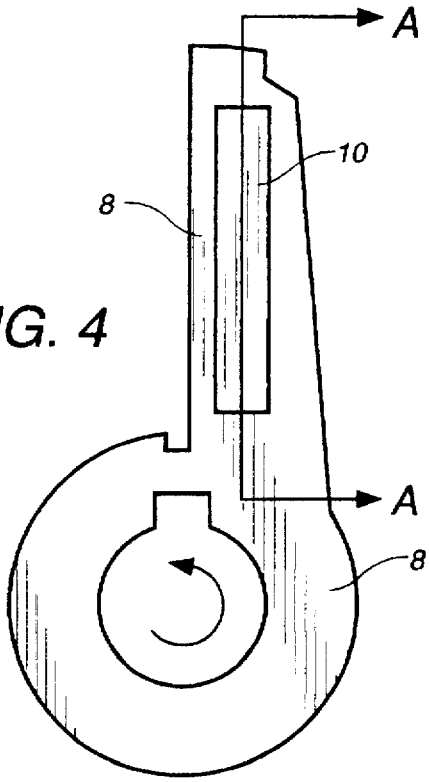
FIGS. 4 and 5 show a plan view and section of a new blade.
Figure 5:
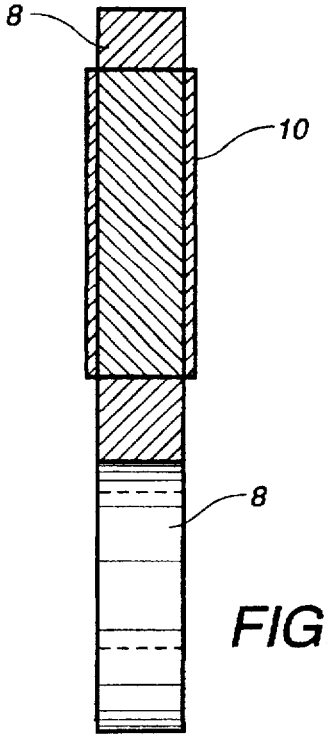
Figure 9:
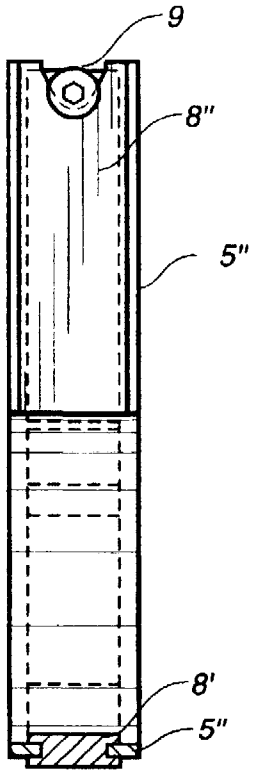
FIGS. 7–9 show frontal partially cross-sectional views of the blade of FIG. 6 with variously attached wear resistant fittings.
Figure 8:
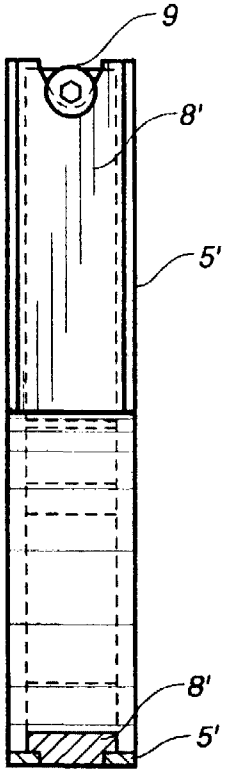
Figure 7:
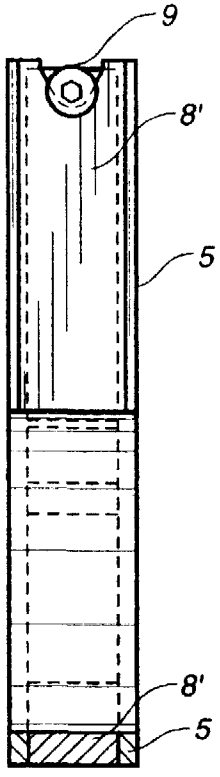
Figure 6:
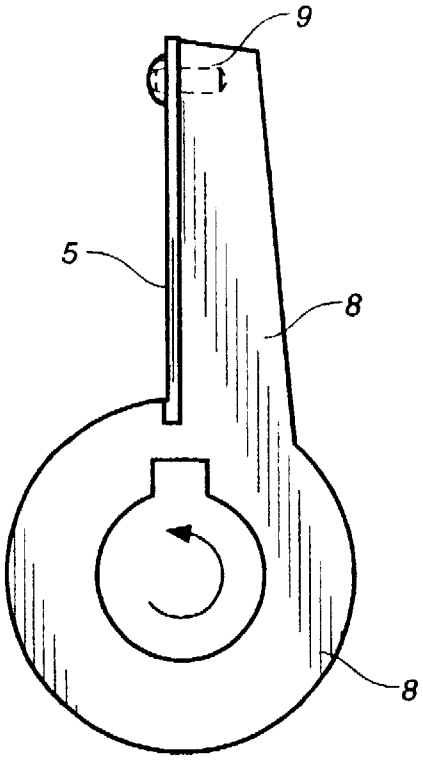
FIG. 6 shows a side view of the blade with a wear resistant fitting.
Figure 11:
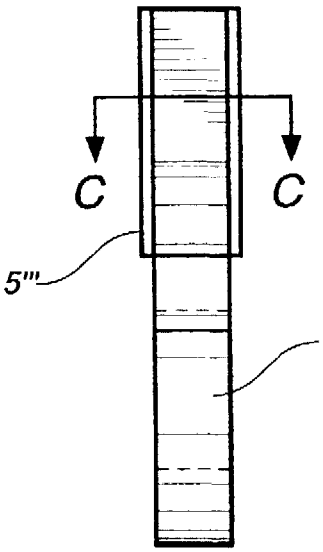
FIGS. 10–12 show a side view, front view and section of a spoke of the new star-shaped cutter.
Figure 12:
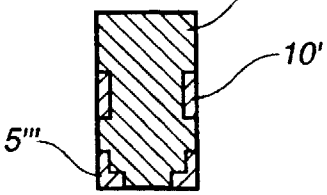
Figure 10:
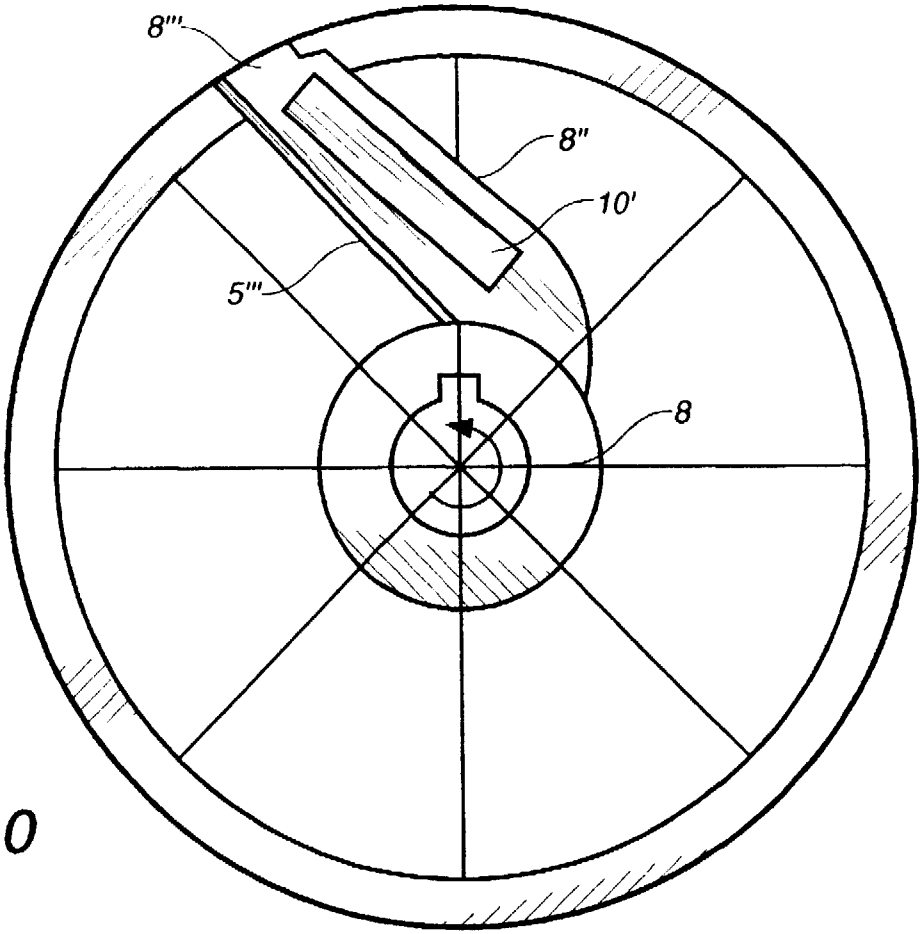

In FIGS. 4–5, the numeral 10 indicates the wear resistant small plate fixed_laterally on the blade holder (8) which contributes to relieve cutting edges (5) from excessive working pressure, keeping them sharp and thus preventing the dispersion of metallic residues into the mince.

In FIGS. 6–9, the numerals 5' and 5" indicate STELLITE (™) or chrome cobalt facings having different shoulders than that of facing (5) to prevent the breaking or separation of the facing material itself. STELLITE (™) is a highly wear and oxidation resistant biocompatible alloy.

In FIGS. 10–12, 8" indicates the back profile of a spoke of the star-shaped cutter (8) facilitating the passage of the mince. 8''' is the front profile thickening the spoke itself so as to better withstand the deflection exerted by the higher speed and stronger pressure in the peripheral area. 5''' indicates the special L-shaped facing fitted not on the blade (8') but directly on each spoke of the star-shaped cutter (8). 10' indicates the small pressure relieving plates, which in this version are in ceramic.

Figure 13:
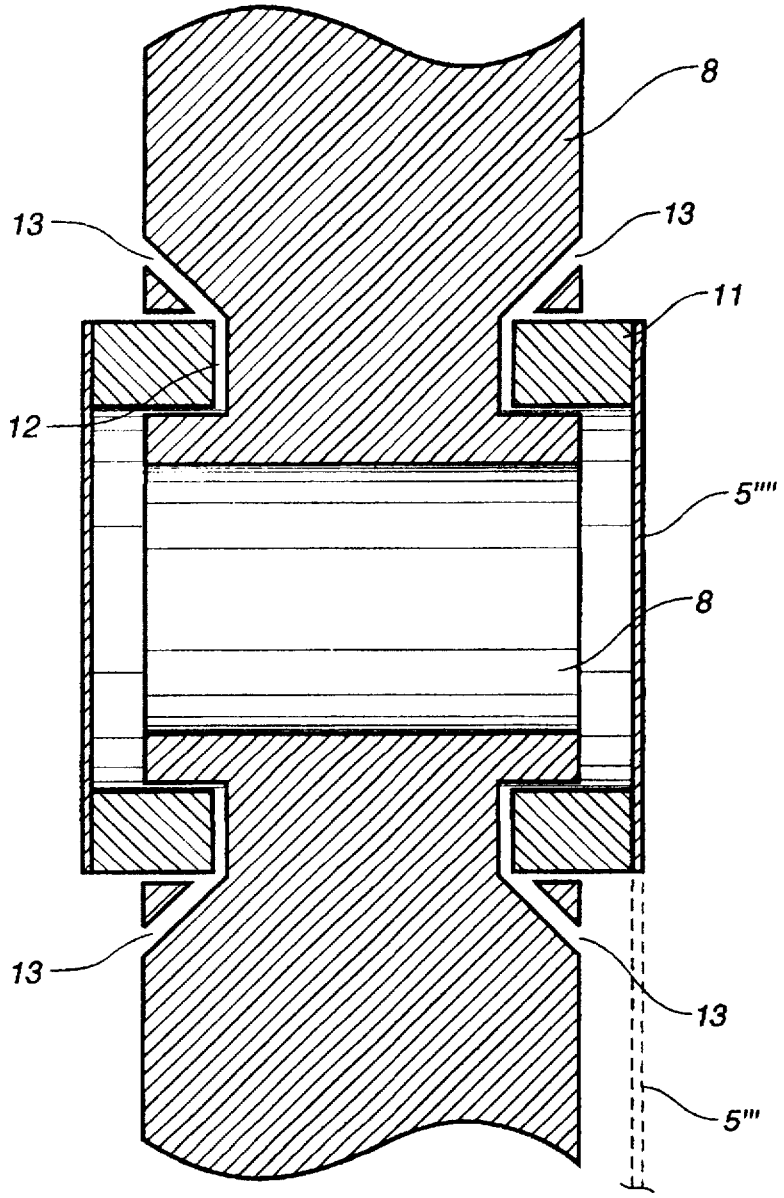
FIG. 13 shows a plan of a freely rotating ring cutter.

In FIG. 13, the numeral 11 indicates the obstructing plate preventing the "short circuiting" of the mince through the conduit (7"); 5'''' indicates the STELLITE (™) or chrome cobalt steel facing on plate (11) so as to make it resistant to wear and as wide as the blades (5); 12 indicates the indentation on the cutter (8) which allows the plate (11) to penetrate inside, while still rotating freely as the mince (water, fat), by penetrating through openings 13, supports it in the appropriate position in contact with the dies on either side of the cutter.

Figure 15:
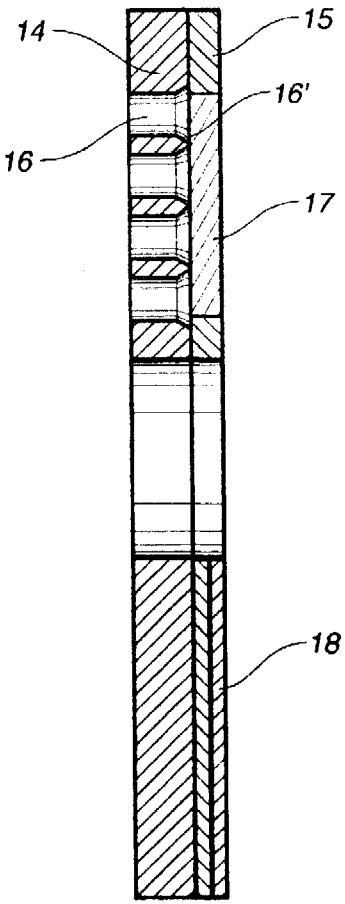
FIGS. 14 and 15 show a plan view and section of the new die design.
Figure 14:
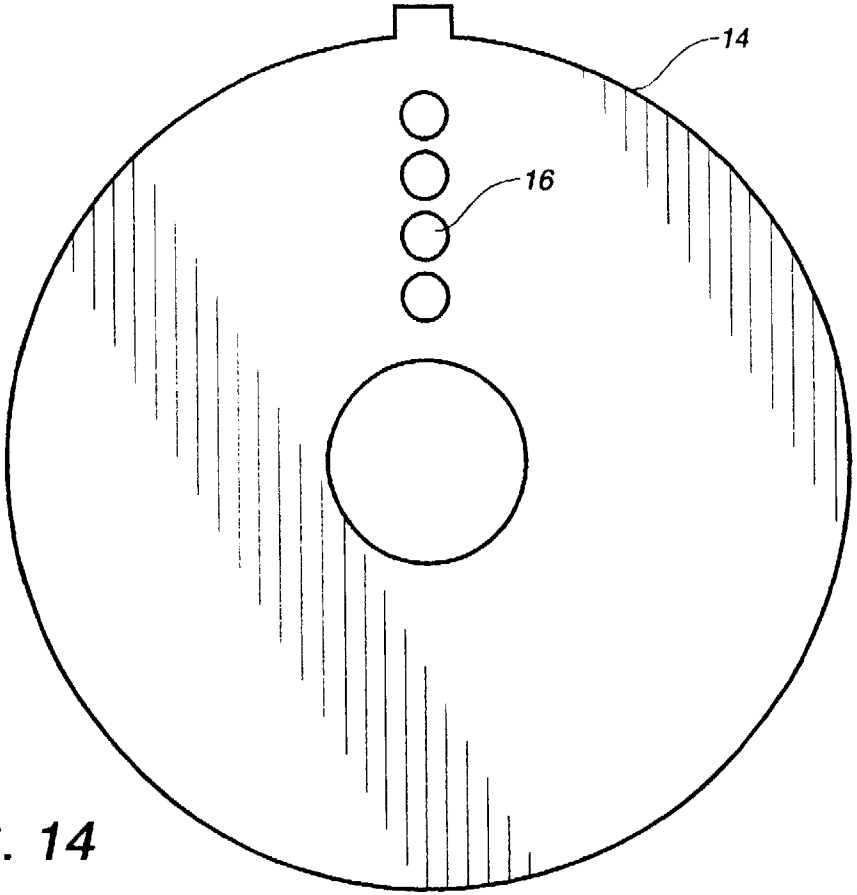

In FIGS. 14–15, the numeral 14 indicates the first support disc for the actual die (15) which, due to its thinness, is to reduce load losses and flex under strong pressure; 16 indicates the large diameter countersunk perforations in 16' on the disk (14) which force the mince only through small diameter perforations (17) on the die (15); 18 indicates the STELLITE (™) or chrome cobalt facing which is also to be fitted on the die.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A mincing unit for an industrial mincing machine comprising a stator, a rotor drivingly connected to a worm screw means, said worm screw means received interior of said stator, said worm screw means, for forcing mince through said stator, a set of disc-shaped dies with progressively closer perforations or tighter mesh, a set of star-shaped cutters alternating with said dies so that said cutters act on said dies at either end, said cutters being fitted with rectangular blades, said blades having a cutting edge surfaced with a wear resistant material, said wear resistant material being fixed externally to the blades, an element of wear resistant material and of rectangular shape is mounted on each spoke of each of the star-shaped cutters so as to relieve pressure from the blades, and a freely rotating plate mounted in an axial area of said cutters, said plate residing in indentations formed in each of said cutters, each of said cutters having conduits extending to said indentations, said plate being held in position by the mince entering the conduits, said plate having a surface aligned with said element of one of the cutters.

2. The mincing unit of claim 1, wherein each of said star-shaped cutters comprises fixed shaped blades with a ceramic insert with a cutting edge of said wear resistant material externally surfacing an "L"-shaped edge of the cutters.

3. The mincing unit of claim 1, wherein said dies are multiple dies formed by a first disc twice as thick as a second disc, said first disc with perforations that are countersunk therein, said perforations in said first disc having a larger diameter than perforations in said second disc, said first disc having a wear resistant material facing in a peripheral area.

4. The mincing unit of claim 1, wherein a facing of one of the cutters is applied by welding.

5. The mincing unit of claim 1, wherein said wear resistant material is a biocompatible alloy.

6. The mincing unit of claim 1, wherein said wear resistant material is chrome cobalt steel.

* * * * *